US005782051A

United States Patent [19]

LaVoie

[11] Patent Number: 5,782,051

[45] Date of Patent: Jul. 21, 1998

[54] WATER RESISTANT LOUVER

[76] Inventor: John F. LaVoie, P.O. Box 15, Springfield, Vt. 05156

[21] Appl. No.: 647,427

[22] Filed: Mar. 11, 1996

[51] Int. Cl.[6] ..... E06B 7/08; F24F 13/08

[52] U.S. Cl. ..... 52/473; 52/198; 52/199; 52/209; 454/277; 454/279; 454/283; 454/358

[58] Field of Search ..... 52/85, 198, 199, 52/209, 473; 454/265, 277, 279, 283, 358

[56] References Cited

U.S. PATENT DOCUMENTS

| | | | |
|---|---|---|---|
| D. 374,085 | 9/1996 | LaVoie | D25/47 |
| 1,972,991 | 9/1934 | Hinkle . | |
| 2,820,407 | 1/1958 | Smith | 454/279 |
| 2,828,711 | 4/1958 | Smith et al. | 52/473 |
| 3,358,580 | 12/1967 | Freese et al. . | |
| 3,771,430 | 11/1973 | Lane . | |
| 3,782,050 | 1/1974 | Dowdell et al. . | |
| 4,103,468 | 8/1978 | Olsen . | |
| 4,452,024 | 6/1984 | Sterriker et al. | 454/277 X |
| 4,785,596 | 11/1988 | Wiley et al. | 52/198 |
| 4,899,647 | 2/1990 | Garries et al. | 454/277 |
| 4,958,555 | 9/1990 | Lentz et al. . | |
| 4,989,384 | 2/1991 | Kinghorn et al. | 52/456 |
| 5,274,976 | 1/1994 | Burkhart | 52/456 |
| 5,297,373 | 3/1994 | Olsen . | |
| 5,349,799 | 9/1994 | Schiedegger et al. | 52/199 X |

*Primary Examiner*—Wynn Wood Coggins
*Assistant Examiner*—Timothy B. Kang
*Attorney, Agent, or Firm*—John J. Welch, Esq.

[57] ABSTRACT

The instant invention is a water resistant louver characterized by an aesthetically pleasing two piece front louver frame affixed to a posteriorally positioned aluminum mesh screen in turn affixed to a spacer frame behind it that encompasses a plurality of horizontally parallel deflector slats affixed to a face plate affixed to the frontal portion of a rear louver frame attached to the screen and front frame via a plurality of fastening screws with all frames and the screen affixed to a positively sloped bottom sill plate, the top side of which is metallically lined to accept water deflected from the slots and a drip cap within the rear louver frame located just behind the lowest of such slats and thereby permit deflected water to run through two identical notches cut into the rear portion of the frontal frame to the outside of the frontal portion of the front frame via two slits in the frontal portion contiguous each with each notch and each of which slits is positioned laterally to a centrally positioned beveled overlay within the frontal portion protected anteriorly by a metallic cover and serving to accept a plurality of fanned blades within the frontal portion and behind which overlay and affixed thereto just anterior to the meshscreen there is a metallic water repellant plate.

8 Claims, 4 Drawing Sheets

WATER RESISTANT LOUVER

CROSS REFERENCES TO PRIOR APPLICATIONS

Figure 1:
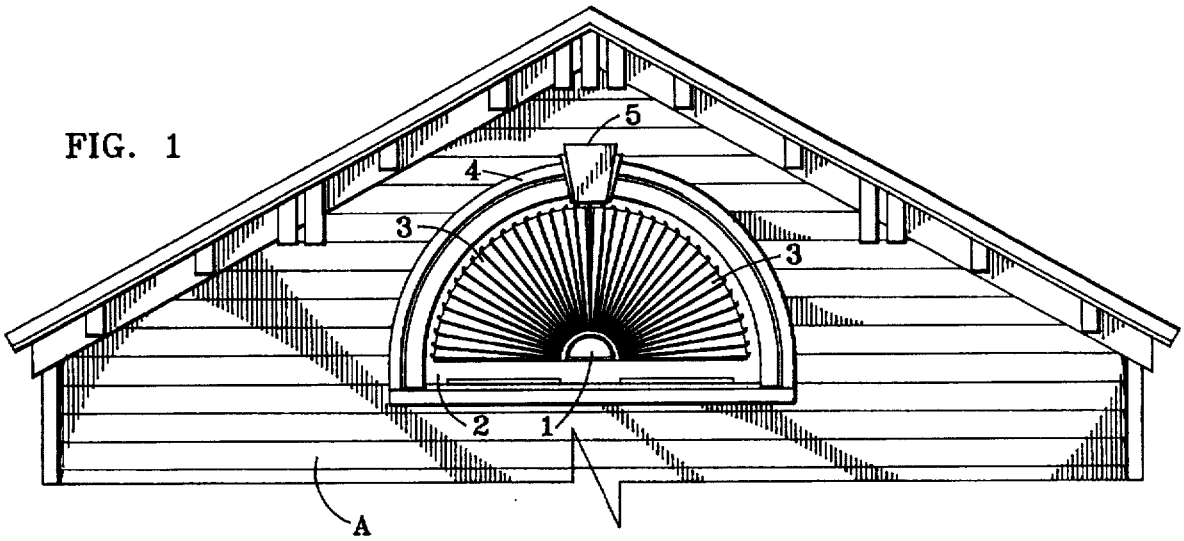

There are no parent applications relating to the instant invention. There is a co-pending design patent application filed by your inventor on the 17th day of Jan., 1995 entitled, Decorative House Louver with Ser. No. 29/033,633.

FEDERALLY SPONSORED RESEARCH AND DEVELOPMENT

There is no federally sponsored research and development associated with the instant invention.

BACKGROUND OF THE INVENTION

1. Field of the Invention

The instant invention relates to those devices that serve to provide ventilation to upper stories of residential dwellings.

2. Prior Art

The following references are exemplary of some art that exists within the field of the instant invention:

| Inventor | Invention | Patent No. | Date |
|---|---|---|---|
| Schiedegger et al | Plastic Gable Vent | 5,349,799 | 9/27/94 |
| B. L. Hinkle | Stormproof Louver | 1,972,991 | 4/13/33 |
| Olsen | Drainable Blade Louver | 5,297,373 | 3/29/94 |
| Garries et al | Ventilator System | 4,899,647 | 2/13/90 |
| Lentz et al | Sight Proof, Drainable Blade Louver Assembly | 4,958,555 | 9/25/90 |
| Sterriker et al | Water Penetration Preventing Louver | 4,452,024 | 6/5/84 |
| Olsen | Drainable Blade Louver | 4,103,468 | 8/1/78 |
| Dowdell et al | Louver Assembly Having Improved Weatherproofing and Air Flow Characteristics | 3,782,050 | 1/1/74 |
| Lane | Louver Assembly | 2,771,430 | 11/13/73 |
| F. A. Freese etal | Louver Assembly Including Separating Traps | 3,358,580 | 12/19/67 |

A SUMMARY OF THE INVENTION

1. A Brief Description of the Invention

The instant invention consists of a frontally positioned conventional house louver frame unit that is fitted posteriorly with an aluminum mesh screen. Also fitted thereto posteriorly and behind the aluminum screen is a rear louver frame. This frame is characterized by the presence of a plurality of built-in parallelwise positioned horizontally lying, metallic or alternatively wooden but metallically covered water deflector slats with spacing between each slat. The metallic or metallically covered slats are typically made of or covered by aluminum due to its light weight and relative resilience to corrosion and oxidation. The ends of each slat are typically encompassed by metallic, typically, aluminum end caps as well. Each such deflector slat is affixed to is in, in turn affixed to the front face of the rear louver frame. Between the conventional front louver frame and the rear louver frame and positioned just posterior to the aluminum mesh screen is a spacing rim that encompasses and circumscribes all of the invention's various deflector slats. A metallic, typically, aluminum drip cap affixed to the rear louver frame is located just behind the lowest positioned one of the deflector slats. The front louver frame, aluminum mesh screen, spacing rim and rear louver frame are all held together typically by fastening screws. Another feature of the instant invention is a blade retainer plate situated just behind the beveled overlay portion of the frontally positioned conventional house louver frame and just in front of the aluminum mesh screen. The front louver frame, aluminum mesh screen, spacer rim and rear louver frame all rest upon and are affixed to a bottom sill plate that is pitched with a positive slope. Between the bottom of each of the frames and the screen and the top side of the sill plate there is to be found a metallic, typically aluminum water shield. The base of the rear portion of the frontal louver frame is characterized by the presence of a pair of small water runoff notches, one on each side of its beveled overlay portion and each notch leads directly into slits cut into the base of the anteriormost portion of the frontal louver frame.

When water passes through the anteriormost portion of the frontal louver frame and is dispensed on the aluminum mesh screen, it then impacts the various deflector slats. Instead of passing directly into an open portion of an attic story of a house having been fitted with the louver, the water drips from the various deflector slats down to the level of the metallically covered top side of the sloping sill plate located between the lie of the aluminum mesh screen and the lie of the porous back plate. The water at this point then passes to the locations of the runoff notches and out through the slits to the outside of the louver where it then simply drips downward to ground. The drip cap serves to provide additional protection against water entering into the open portion of the attic story having been filled with the louver.

2. Objects of the Invention

House louvers installed into the upper stories of residences function primarily to ensure the degree of ventilation such as would be critical in order to facilitate sufficient air circulation throughout the ventilated area in order to promote an appropriate movement throughout of moisture and hot air to be ultimately evacuated. However, conventional louvers that are adequate to this task are by virtue of the same, necessarily limited in terms of their otherwise inherent aesthetics. It is invariably the case that enhanced aesthetics must be sacrificed for the sake of ensuring that water only minimally finds its way through a louver and into a house open through the louver to the outside.

Respectfully submitted, the instant invention is veritably revolutionary in the art of producing louvers insomuch as it very clearly minimizes almost totally the passage of external moisture, namely rainwater into a house open through it to the outside while at the same time allowing for virtually unlimited creativity as respects aesthetics.

Thus the instant invention serves to wholly satisfy the objective of minimizing to the fullest possible extent any seepage of moisture into a residence while at the same time maximizing to the fullest possible extent that range of aesthetic creativity that can serve to mark a given louver or set of louvers as being truly pleasing works of art especially when matched up with a particular one of a plethora of uniquely designed residential dwellings.

A DESCRIPTION OF THE DRAWINGS

1. FIG. 1 is a frontal view of an embodiment of the instant invention shown installed in the upper story of a house.

Figure 2:
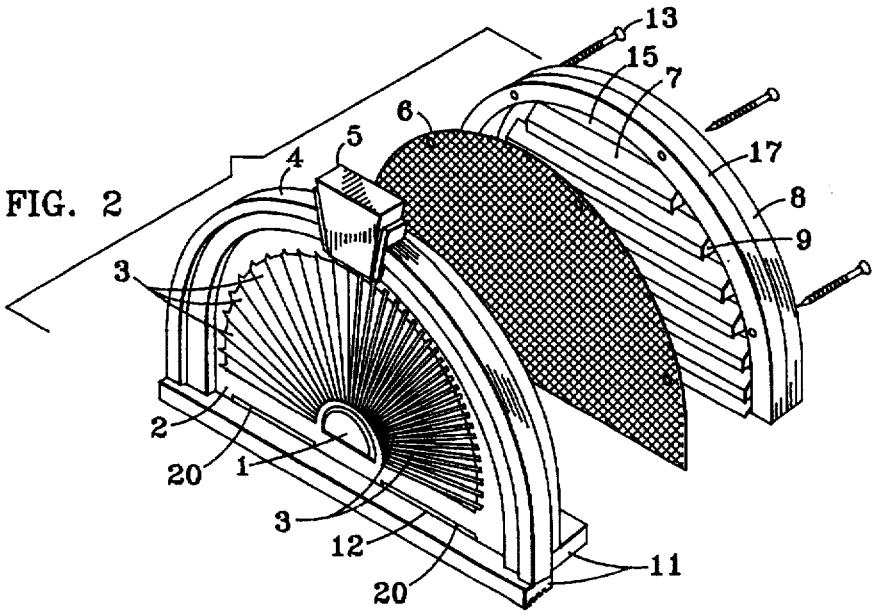

2. FIG. 2 is an exploded perspective view of an embodiment of the instant invention.

Figure 3:
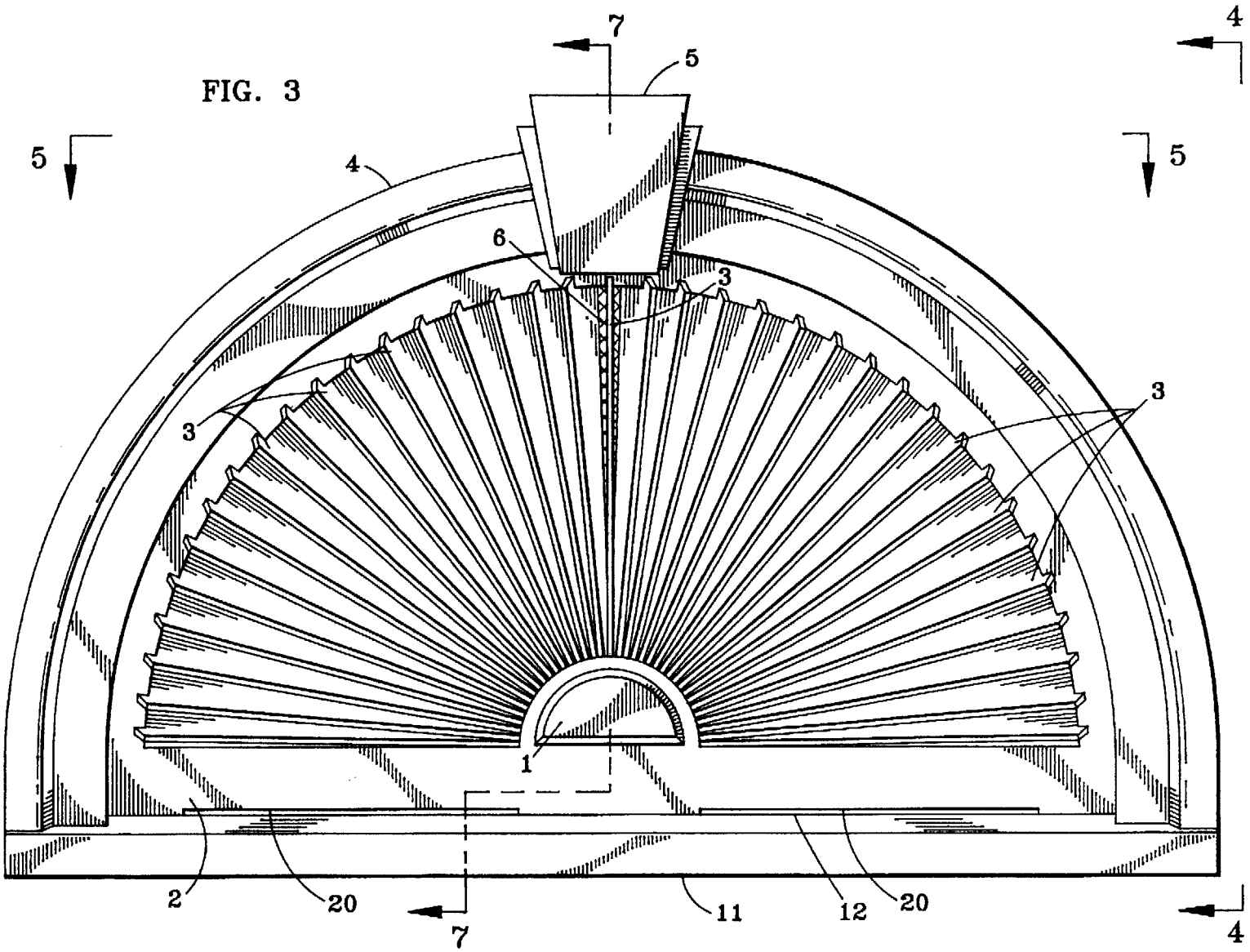

3. FIG. 3 is a frontal view of an embodiment of the instant invention.

Figure 4:
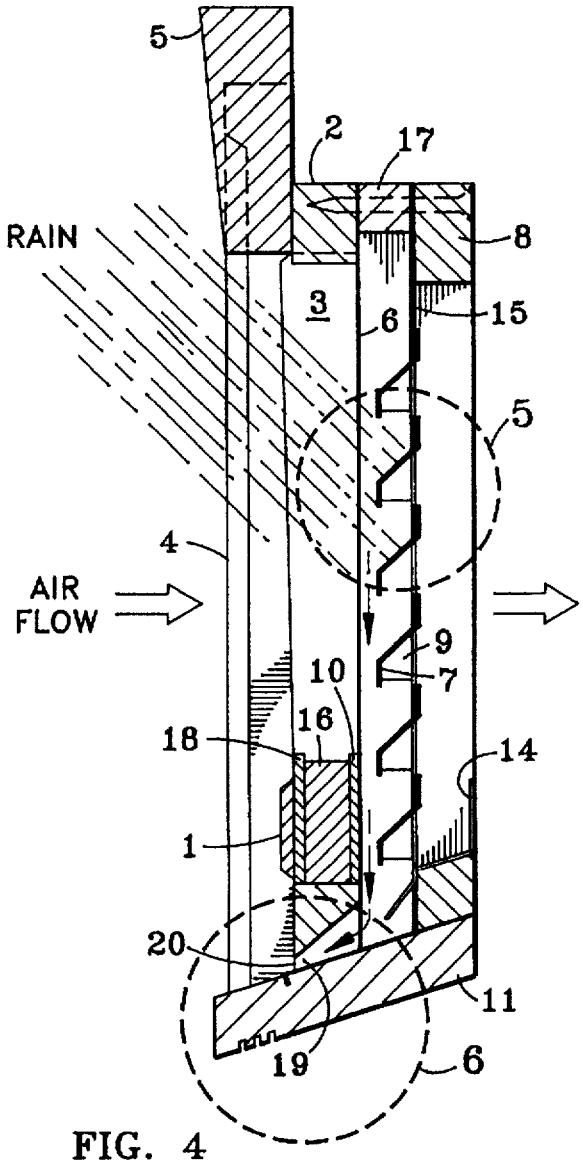

4. FIG. 4 is a lateral cross-sectional view of the medial aspect of the instant invention.

Figure 5:
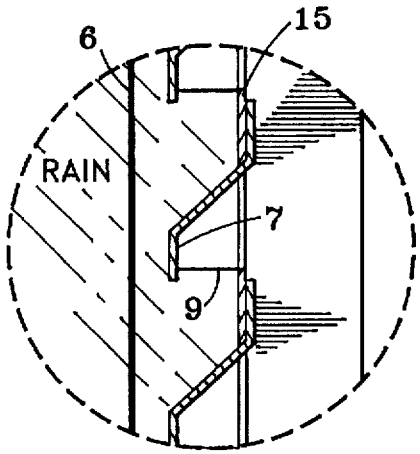

5. FIG. 5 is an isolated close-up view of a portion of what is seen in FIG. 4, namely one of the instant invention's deflector slats.

Figure 6:
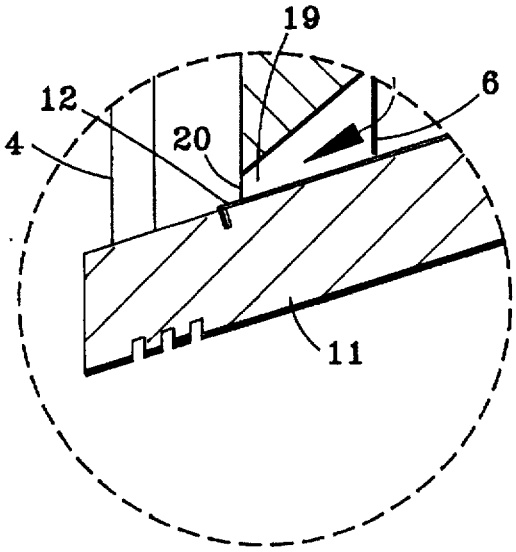

6. FIG. 6 is an isolated close-up view of another portion of what is seen in FIG. 4, namely one of the instant invention's two identical water runoff notches.

Figure 7:
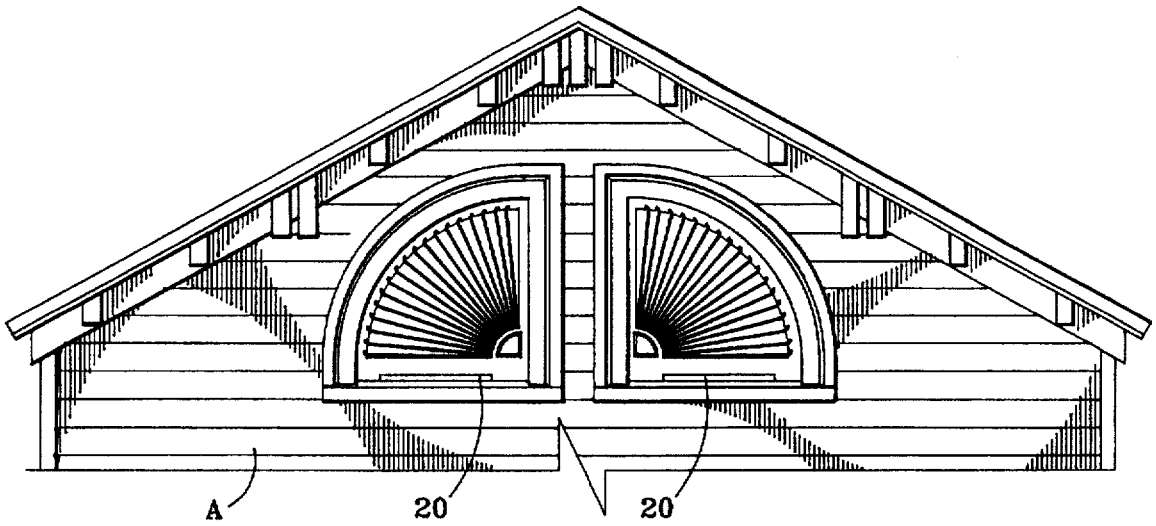

7. FIG. 7 is a frontal view of a second embodiment of the instant invention shown installed in the upper story of a house.

A DESCRIPTION OF THE PREFERRED EMBODIMENT

FIG. 1 and FIG. 7 are depictions of but two variants of the instant invention. Both FIG. 1 and FIG. 7 illustrate in frontal view, the instant invention, as it would appear, installed in an upper story of a residential dwelling A. FIG. 1 is a depiction of an installed single unit. FIG. 7 is a depiction of an installed pair of so-called quarter units. It goes without saying that where desired and appropriate, the instant invention could also serve to decoratively ventilate the upper story of a given commercial building as well. The instant invention is made up of a two piece intact front louver frame 2 that is its variable decorative component. The frontal portion of front louver frame 2 consists typically of circumscribing casing 4 and likewise supports as well a purely decorative key 5. FIG. 2 is a perspective view of front louver frame 2. One can appreciate from a purview of not only FIG. 2 but also FIG. 3, the blading 3 of front louver frame 2 that originates from within a gear hub 16 seen in FIG. 4 circumscribed by a gear hub cover 18 also seen in FIG. 4 in the vicinity of a beveled overlay 1 and fanning gently but with exquisite symmetry into the body of front louver frame 2 marked also by frame 2's exterior casing 4 and decorative key 5. Gear hub cover 18 is typically metallic and serves to protect gear hub 16 typically made of wood from corrosion or damage otherwise due to continuing intermittent contact with water. Blade retainer plate 10 seen in FIG. 4 likewise serves as an insulator against water encroachment as well as to facilitate holding blading 3 in place within gear hub 16. By virtue of the novel and unique integration of the various other components of the instant invention as will be noted in the discussion which is to follow shortly, there are veritably unlimited possibilities as respects the aesthetic design modalities with regards to the front louver frame 2, since, no longer must the desired design of a front louver frame 2 be constrained by concerns revolving about fears that any erstwhile inordinate degree of moisture will find its way through a louver and into the inner portion of a building A fitted with the louver. Such design constraints with respect to all such louvers, as are now manufactured as, for example, the number or lie of various pieces of blading 3 as might be possible from an aesthetic vantage point, are obviated completely by virtue of resort to utilization of the instant invention. As respects the novel, unique and eminently useful components of the instant invention, FIG. 4, a lateral view of the instant invention in conjunction with FIG. 2 serves to illustrate the manner in which two piece front louver frame 2 is assembled to aluminum mesh screen 6 just behind frame 2, spacer rim 17 just behind screen 6 and rear louver frame 8 just behind spacer rim 17 via fastening screws 13 and atop and affixed to sill 11. FIG. 4 moreover shows how the instant invention's blade retainer plate 10 fits between screen 6 and gear hub 16 that receives blading 3 as well as showing gear hub cover 18 in front of gear hub 16 and just behind beveled overlay 1. FIG. 4 and FIG. 5 enable one to appreciate the horizontal parallelwise positioning of the instant invention's plurality of metallic deflector slats 7 all metallically endcapped with endcaps 9. All deflector slats 7 are affixed to a face plate 15 as seen in FIGS. 4 and 5 which face plate 15 is affixed to the whole of the anterior side of rear louver frame 8. Aluminum mesh screen 6 serves not only to impede inwardly driven rainwater but also to catch external debris such as leaves or twigs that might otherwise work through porous face plate 15 and into the building A fitted with the louver. The porousness of the spaces between deflector slats 7 permits the flow of air as depicted in FIG. 4 to and from the upper story sought to be ventilated by virtue of the installation of the instant invention within the upper walling of the building A. Spacer rim 17 circumscribes the various deflector slats 7 as noted with resort to FIGS. 2 and 4 thus providing for a fully intact louver unit with adequate room therein for deflector slats 7 to function as rainwater deflectors. When rain penetrates the instant invention as shown in FIG. 4, it is maximally deflected from the interior of a building A into which the instant invention would have been installed by virtue of its impacting on the instant invention's various deflector slats 7 and then falling downwards therefrom as per the arrows seen in FIG. 4. A backup base level deflector drip cap plate 14 also seen in FIG. 4 serves to catch any motely raindrops that may have splashed through porous screen 15 after falling off deflector slats 7. Once penetrating rain has fallen as per the arrows in FIG. 4, it pools atop the metallic cover 12 affixed atop sill 11 and then by virtue of the positive pitch of sill 11 further falls, as seen in FIG. 4 and highlighted in FIG. 6, via a pair of identical notches 19 cut at a bias through the base of the rear portion of front louver frame 2 out through an identical pair of drainage slots 20 as seen with resort to FIGS. 4, 6 and, for example also, FIG. 3 or as respects the embodiment namely paired quarter units so-called as seen in FIG. 7 via one notch 19 per unit cut at a bias through the base of the rear portion of front louver frame 2 out through one drainage slot 20 per unit. FIG. 4 shows in lateral view the placement of deflector slats 7 with end caps 9 on face plate 15 as well as the location of deflector drip cap plate 14, all being integral parts of rear lower frame 8.

Metallic cover 12 protects sill 11, made typically of wood, from water and concomitant rotting over time. The instant invention's metallic components, screen 6, slats 7, cover 12, plate 14 and plate 15 are typically aluminum due to its relative resistance to corrosion or oxidation and light weight as well. As can be noted from the previous discussion, it is the novel and unique combination of the plurality of deflector slats 7 mounted to face plate 15 along with mounted deflector drip cap plate 14 within rear louver frame 8 with slats 7 circumscribed by spacer rim 17 together with notches 19 within a portion of the base of the rear portion of front louver frame 2 leading along the topside of positively pitched sill 11 covered with metallic cover 12 to and out through drainage slots 20 that enables one to design without constraints predicated upon the concern for erstwhile penetrating water, the frontal portion of front louver frame 2 in any creatively aesthetic manner deemed desirable. This novel and unique combination permits the effects of slats 7 and cap 14 deflection along with the effect of basic gravity to prevent untoward water penetration into a building A fitted with the instant invention. As previously noted, the whole of the aforementioned assembly from front frame 2 back to rear frame 8 can be accomplished regardless of the geometric configuration of the instant invention whether, for example, an intact louver as shown in FIG. 1 or a pair of quarter units as shown in FIG. 10 is sought to be constructed.

In conclusion, respectfully submitted, the instant invention's penchant for limitless beauty in conjunction with optimal function as regards the matter of permitting air flow to and through the upper story of a building A fitted with the invention while at the same time maximally limiting water penetration into such a building renders it truly revolutionary within the ambit of the art of louver construction.

What is claimed is:

1. A water resistant louver, comprising:

a. a two piece front louver frame with a frontal portion of said front louver frame affixed to a rear portion of said frontal louver frame;

b. a gearhub centrally positioned within said rear portion of said front louver frame;

c. a plurality of symmetrically positioned pieces of decorative blading each of said plurality having a first end and a second end and being positioned and held each at said first end of said each of said plurality to and within said rear portion of said front louver frame and said each being accepted at said second end of said each of said plurality by notches in said gearhub;

d. a water resistant gear hub blade retainer plate affixed to a backside of said gearhub;

e. a mesh screen unit lying affixed to a posterior side of said rear portion of said front louver frame with a screen perimeter and screen shape equal to a perimeter and a shape of said rear portion of said front louver frame;

f. a hollow spacer rim affixed to a posterior side of said mesh screen unit with an external shape and external perimeter being equal to said screen shape and said screen perimeter of said mesh screen;

g. a rear louver frame with flooring;

h. a porous face plate affixed anteriorly to said rear louver frame and with all of said affixed porous face plate and all of said rear louver frame being affixed to a posterior side of said hollow spacer rim with said porous face plate having a shape and a perimeter equal to said screen shape and said screen perimeter of said mesh screen as well as further being equal to a shape and a perimeter of said rear louver frame;

i. a plurality of horizontally positioned deflector slats affixed parallelwise to a front side of said porous face plate which said slats are all in the shape of a rectangle initially affixed to and abutting the lie of said face plate then bent at an initial angle outward with an inclination towards the lie of said mesh screen then bent again downward at a subsequent angle equal in size to the size of said initial angle;

j. a protective deflector drip cap plate affixed to and positioned within said rear louver frame and to a posterior side of said rear louver frame behind and just below a lowest positioned one of said deflector slats which said protective drip cap is in the shape of a rectangle covering an upper surface of said flooring of said rear louver frame and with a first bend upwardly at a first angle at a posterior edge of said flooring so, as to, form a situs of said first bend lie affixed to the said posterior side of said louver frame parallel to the said lie of said face plate, then with a bend downwardly at a second angle at an anterior edge of said flooring so as to incline initially vertically downward from a situs of said second bend and then with a third bend at a third angle below a locus of said second bend so as to incline downward towards said lie of said mesh screen;

k. a positively pitched sill unit, the top surface of which is partially covered by a water retardant shield and to which said sill unit there are attached from front to rear, said two piece front louver frame, said mesh screen, said spacer rim, said porous face plate and said rear louver frame;

l. a plurality of notches cut at a bias into a plurality of portions of a base of said rear portion of said front louver frame, and:

m. a plurality of slots cut into a front of said rear portion of said front louver frame that each connect directly with each of said notches.

2. The water resistant louver of claim 1 whereby metallic endcaps cover both ends of each of said plurality of horizontally positioned deflector slats.

3. A water resistant louver, comprising:

a. a two piece front louver frame with a frontal portion of said front louver frame affixed to a rear portion of said frontal louver frame;

b. a gearhub centrally positioned within said rear portion of said front louver frame;

c. a plurality of symmetrically positioned pieces of decorative blading each of said plurality having a first end and second end and being positioned and held each at said first end of said each of said plurality to and within said rear portion of said front louver frame and said each being accepted at said second end of said each of said plurality by notches in said gearhub;

d. a water resistant gearhub blade retainer plate affixed to a backside of said gearhub;

e. a water resistant gearhub cover circumscribing a whole outer rim of said gearhub;

f. a mesh screen unit lying affixed to a posterior side of said rear portion of said front louver frame with a screen perimeter and screen shape equal to a perimeter and a shape of said rear portion of said front louver frame;

g. a hollow spacer rim affixed to a posterior side of said mesh screen unit with an external shape and external perimeter being equal to said screen shape and said screen perimeter of said mesh screen;

h. a rear louver frame with flooring;

i. a porous face plate affixed anteriorly to said rear louver frame and with all of said affixed porous face plate and all of said rear louver frame being affixed to a posterior side of said hollow spacer rim with said porous face plate having a shape and a perimeter equal to said screen shape and said screen perimeter of said mesh screen as well as further being equal to a shape of and a perimeter of said rear louver frame;

j. a plurality of horizontally positioned deflector slats affixed parallelwise to a front side of said porous face plate which said slates are all in the shape of a rectangle initially affixed to and abutting the lie of said face plate then bent at an initial angle outward with an inclination towards the lie of said mesh screen then bent again downward at a subsequent angle equal in size to the size of said initial angle;

k. a protective drip cap plate affixed to and positioned within said rear louver frame and to a posterior side of said rear louver frame behind and just below a lowest positioned one of said deflector slats which said protective drip cap is in the shape of a rectangle covering an upper surface of said flooring of said rear louver frame and with a first bend upwardly at a first angle at a posterior edge of said flooring so as, to from a situs of said bend, lie affixed to the said posterior side of said louver frame parallel to the said lie of said face plate, then with a second bend downwardly at a second angle at an anterior edge of said flooring so as to incline initially directly downward from a situs of said second bend and then with a third bend at a third angle below a locus of said second bend so as to incline downward towards said lie of said mesh screen;

l. a positively pitched sill unit, the top surface of which is partially covered by a water retardant shield and to which said sill unit there ate attached from front to rear, said two piece front louver frame, said mesh screen, said spacer rim, said porous face plate and said rear louver frame;

m. a plurality of notches cut at a bias into a plurality of portions of a base of said rear portion of said front louver frame, and;

n. a plurality of slots cut into a front of said rear portion of said front louver frame that each connect directly with each of said notches.

4. The water resistant louver of claim 3 whereby metallic endcaps cover both ends of each of said plurality of horizontally positioned deflector slats.

5. A water resistant louver, comprising:

a. a two piece front louver frame with a frontal portion of said front louver frame affixed to a rear portion of said frontal louver frame;

b. a gearhub centrally positioned within said rear portion of said front louver frame;

c. a plurality of symmetrically positioned pieces of decorative blading each of said plurality having a first end and being positioned and held each at said first end of said each of said plurality to and within said rear portion of said frontal louver frame and said each being accepted at said second end of said each of said plurality by notches in said gearhub;

d. a water resistant gear hub blade retainer plate affixed to a backside of said gearhub;

e. a mesh screen unit lying affixed to a posterior side of said rear portion of said front louver frame with a screen perimeter and screen shape equal to a perimeter and a shape of said rear portion of said front louver frame;

f. a hollow spacer rim affixed to a posterior side of said mesh screen unit with an external shape and external perimeter being equal to said screen shape and said screen perimeter of said mesh screen;

g. a rear louver frame with flooring;

h. a porous face plate affixed anteriorly to said rear louver frame and with all of said affixed porous face plate and all of said rear louver frame being affixed to a posterior side of said hollow spacer rim with said porous face plate having a shape and a perimeter equal to said screen shape and said screen perimeter of said mesh screen as well as further being equal to a shape of and a perimeter of said rear louver frame;

i. a plurality of horizontally positioned deflector slats affixed parallelwise to a front side of said porous face plate which said slats are all in the shape of a rectangle initially affixed to and abutting the lie of said face plate then bent at an initial angle outward with an inclination towards the lie of said mesh screen then bent again downward at a subsequent angle equal in size to the size of said initial angle;

j. a protective deflector drip cap plate affixed to and positioned within said rear louver frame and to a posterior side of said rear louver frame behind and just below a lowest positioned one of said deflector slats which said protective drip cap is in the shape of a rectangle covering an upper surface of said flooring of said rear louver frame and with a first bend upwardly at a first angle at a posterior edge of said flooring so, as to, form a situs of said first bend lie affixed to the said posterior side of said louver frame parallel to the said lie of said face plate, then with a bend downwardly at a second angle at an anterior edge of said flooring so as to incline initially vertically downward from the situs of said second bend and then with a third bend at a third angle below a locus of said second bend so as to incline downward towards said lie of said mesh screen;

k. a positively pitched sill unit, the top surface of which is partially covered by a water retardant shield and to which said sill unit there are attached from front to rear, said two piece front louver frame, said mesh screen, said spacer rim, said porous face plate and said rear louver frame;

l. a notch cut at a bias into a base of said rear portion of said front louver frame, and;

m. a slot cut into a front of said rear portion of said front louver frame that connects directly with said notch.

6. The water resistant louver of claim 5 whereby metallic endcaps cover both ends of each of said plurality of horizontally positioned deflector slats.

7. A water resistant louver, comprising:

a. a two piece front louver frame with a frontal portion of said front louver frame affixed to a rear portion of said frontal louver frame;

b. a gearhub centrally positioned within said rear portion of said front louver frame;

c. a plurality of symmetrically positioned pieces of decorative blading each having a first end and a second end and being positioned and held each at said first end of said each of said plurality to and within said rear portion of said front louver frame and said each being accepted at said second end of said each of said plurality by notches in said gearhub;

d. a water resistant gearhub blade retainer plate affixed to a backside of said gearhub;

e. a water resistant gearhub cover circumscribing the whole outer rim of said gearhub;

f. a mesh screen unit lying affixed to a posterior side of said rear portion of said front louver frame with a screen perimeter and screen shape equal to a perimeter and a shape of said portion of said front louver frame;

g. a hollow spacer rim affixed to a posterior side of said mesh screen unit with an external shape and external perimeter being equal to said screen shape and said screen perimeter of said mesh screen;

h. a rear louver frame with flooring;

i. a porous face plate affixed anteriorly to said rear louver frame and with all of said affixed porous face plate and all of said rear louver frame being affixed to a posterior side of said hollow spacer rim with said porous face plate having a shape and a perimeter equal to said screen;

a plurality of horizontally positioned deflector slats affixed parallelwise to a front side of said porous face plate which said slats are all in the shape of a rectangle initially affixed to and abutting the lie of said face plate then bent at an initial angle outward with an inclination towards the lie of said mesh screen then bent again downward at a subsequent angle equal in size to the size of said initial angle;

k. a positively pitched sill unit, the top surface of which is partially covered by a water retardant shield and to which said sill unit there are attached from front to rear, said two piece front louver frame, said mesh screen, said spacer rim, said porous face plate and said rear louver frame;

l. a notch cut at a bias into a base of said rear portion of said front louver frame; and;

m. a slot cut into a front of said rear portion of said front louver frame that connects directly with said notch.

8. The water resistant louver of claim 7 whereby metallic endcaps cover both ends of each of said plurality of horizontally positioned deflector slats.

* * * * *